US008695612B2

(12) United States Patent
Parra et al.

(10) Patent No.: US 8,695,612 B2
(45) Date of Patent: Apr. 15, 2014

(54) BIN WASHER DEVICE WITH ROTATING BIN HOLDER AND METHOD OF WASHING BINS

(75) Inventors: Jim Parra, Reedley, CA (US); Robert Guerra, Reedley, CA (US); Bruce Adams, Fillmore, CA (US); David Sorenson, Visalia, CA (US)

(73) Assignees: Valley Packline Solutions, Reedley, CA (US); Fruit Growers Supply Company, Sherman Oaks, CA (US)

( * ) Notice: Subject to any disclaimer, the term of this patent is extended or adjusted under 35 U.S.C. 154(b) by 960 days.

(21) Appl. No.: 12/700,137

(22) Filed: Feb. 4, 2010

(65) Prior Publication Data

US 2010/0192984 A1 Aug. 5, 2010

Related U.S. Application Data

(60) Provisional application No. 61/150,193, filed on Feb. 5, 2009.

(51) Int. Cl.
*B08B 3/00* (2006.01)

(52) U.S. Cl.
USPC ..... 134/124; 134/23; 134/62; 134/128

(58) Field of Classification Search
USPC ..... 134/62, 79, 124, 128, 23
See application file for complete search history.

(56) References Cited

U.S. PATENT DOCUMENTS

| | | | | | |
|---|---|---|---|---|---|
| 2,718,297 | A | * | 9/1955 | Wilde | 198/729 |
| 3,382,844 | A | * | 5/1968 | Kumpf | 118/58 |
| 3,385,333 | A | * | 5/1968 | Eynon | 144/338 |
| 3,481,348 | A | * | 12/1969 | Schultz | 134/126 |
| 3,606,896 | A | * | 9/1971 | Holm | 134/79 |
| 3,677,273 | A | * | 7/1972 | Mahlstede et al. | 134/127 |
| 4,062,437 | A | * | 12/1977 | Knapp | 198/346.2 |
| 5,378,287 | A | * | 1/1995 | Pedziwiatr | 134/1 |

* cited by examiner

*Primary Examiner* — Michael Barr
*Assistant Examiner* — Benjamin L Osterhout
(74) *Attorney, Agent, or Firm* — Procopio, Cory, Hargreaves & Savitch LLP

(57) ABSTRACT

A bin washer device for washing bins including a conveyor for moving the bins in a conveying direction, a support and at least two bin holders rotatably supported on the support for rotation about an axis adjacent the conveyor.

12 Claims, 4 Drawing Sheets

BIN WASHER DEVICE WITH ROTATING BIN HOLDER AND METHOD OF WASHING BINS

BACKGROUND OF THE INVENTION

1. Technical Field of the Invention

Illustrative, non-limiting embodiments of the present invention relate generally to a bin washing device, particularly, for washing bins used to convey plant products, such as fruit.

2. Background of Related Art

During fruit packing and processing operations, the fruit is typically stored or transported in bins, which are typically about 48"×48"×30" deep and which after use for storing or transporting the fruit, must be washed in order to remove plant residue, mold, decayed material, dirt, leaves, twigs and the like. The washing process must be efficient and involve a minimum of human activity. Accordingly, bin washer devices have been incorporated into conveyor systems to facilitate automatic washing of the bins. In one conventional bin washer device, a bin is conveyed open side up to a washing station where it is rotated until its interior surfaces face down. The bin is then lifted to provide access to the internal surfaces. The bin interior is sprayed from below by a lower spray. Typically, a single overhead spray is positioned to spray water and sanitizer onto the outer surfaces of the bins. Thereafter, the bin is dropped back onto the conveyor or into a bin collecting area such as a bin stacker. With such an arrangement, only a single bin can be washed by a washing station at one time. That is, one bin must be completely washed before the next bin can begin to be washed.

In these bin washing devices, the time required to wash a single bin must be less than the time it takes a packinghouse to dump fruit from a single bin. For example, if a packinghouse is dumping fruit at 30 seconds per bin, conventional bin washers have less than 30 seconds to wash a bin. Furthermore, the time required to lift the bin is not part of the wash time, resulting in a relatively short wash time per bin.

Oftentimes with the conventional bin washers, pathogens are not effectively killed because the sanitizers cannot be applied to the bins for a sufficient amount of time. Furthermore, some of the bins have pocketed cleats and/or bin runners on a bottom surface of the bin. Dirt or mud and the like that becomes lodged in these cleats or runners is difficult to remove and the conventional bin washers do not effectively remove foreign material from these areas. Additionally, dried or decayed fruit on the internal and external surfaces of the bin can be difficult to remove and are not effectively removed with a short wash time or a single overhead spray.

Accordingly, there remains a need for an improved bin washer that can effectively remove dirt, plant residue, mold, decayed material, or dried fruit from all surfaces, both interior and exterior, of the bins and effectively kill pathogens, while performing such functions without slowing down the plant product dumping process.

SUMMARY OF THE INVENTION

Illustrative, non-limiting embodiments of the present invention overcome various of the foregoing and additional disadvantages and problems. In addition, the present invention is not required to overcome all these disadvantages, and an illustrative, non-limiting embodiment of the present invention may not overcome any problems, but may simply provide another way of performing a method or achieving a desired result.

An illustrative, non-limiting embodiment of the bin washer device comprises: a conveyor for moving the bins in a conveying direction; a support; and at least two bin holders rotatably supported on the support for rotation about a longitudinal axis.

An illustrative, non-limiting embodiment of the method of washing bins comprises: conveying the plural bins in sequence on a conveyor to a multibin washing station with a rotatable support having N bin holders, wherein N is an integer equal to 2 or more; stopping a rotation of the support; discharging one of the plural bins from an x one of the bin holders, wherein x is an integer from 1 to N; receiving a next one of the plural bins in the x one of the bin holders; and rotating the support and washing the bins in the bin holders. The stopping the rotation, the discharging the one of the plural bins, the receiving of the next one of the plural bins, and the rotating of the support and washing of the bins in the bin holders are reiterated sequentially for each value of x from 1 to N. The reiterating is repeated to continuously wash the bins.

The present bin washer device extends the wash time of each bin, allowing the sanitizer to effectively kill pathogens. Additionally, the present bin washer more effectively removes dirt and mud from the bins including that within the cleats, and removes dried or decayed fruit from the internal and external surfaces of the bin.

BRIEF DESCRIPTION OF THE DRAWINGS

Features and advantages of illustrative, non-limiting embodiments of the present invention will become more apparent from a reading of the following description. The accompanying drawings, which are incorporated in and constitute a part of this specification, illustrate exemplary embodiments of the invention and, together with the description, serve to explain the aspects, advantages and principles of the embodiments. In the drawings.

DETAILED DESCRIPTION OF THE INVENTION

Illustrative, non-limiting embodiments of the present invention will now be described more fully with reference to the accompanying drawings.

Figure 1:
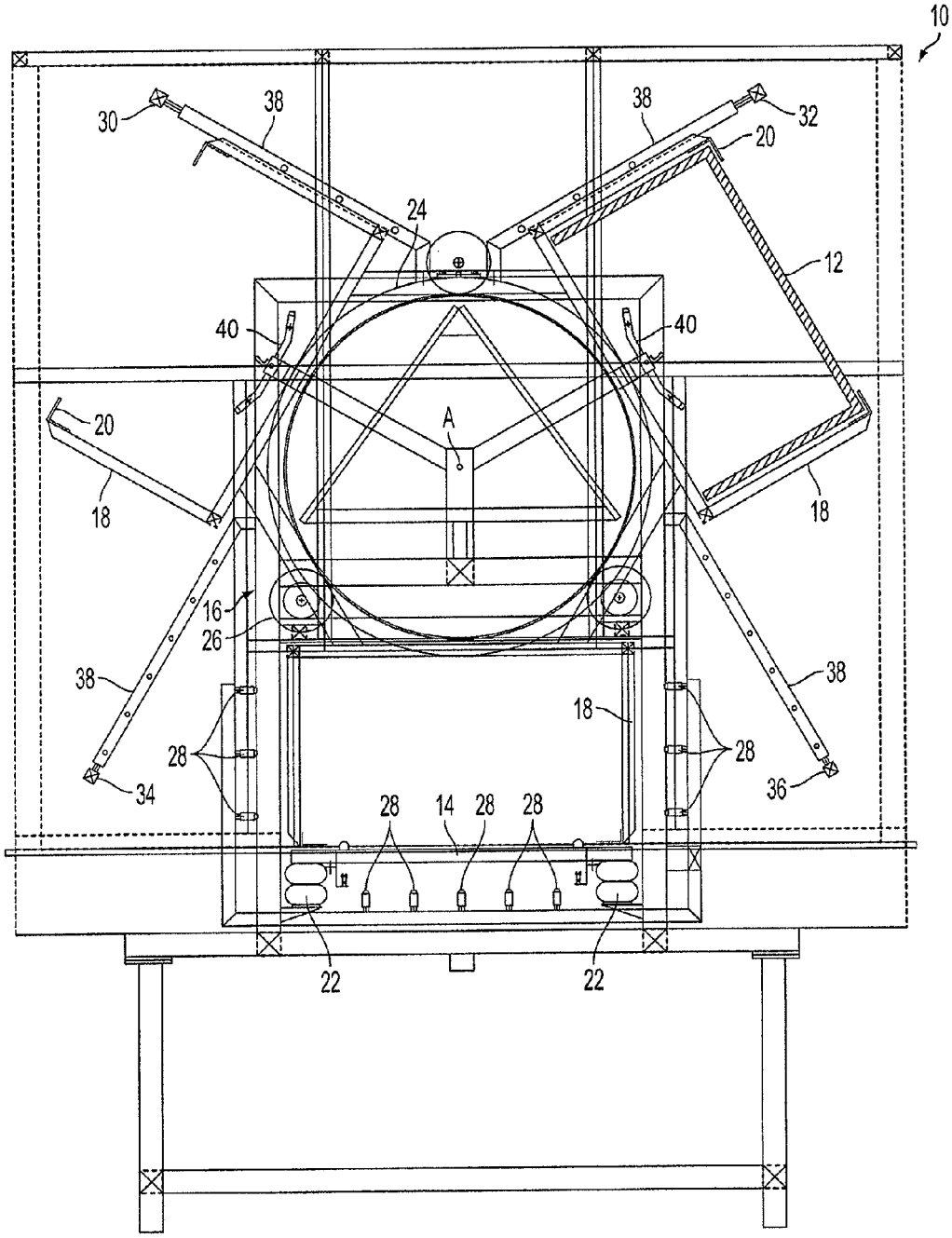
FIG. 1 is a front cross sectional view of a bin washer according to an exemplary embodiment of the present invention illustrating a bin in one of the bin holders.
Figure 2:
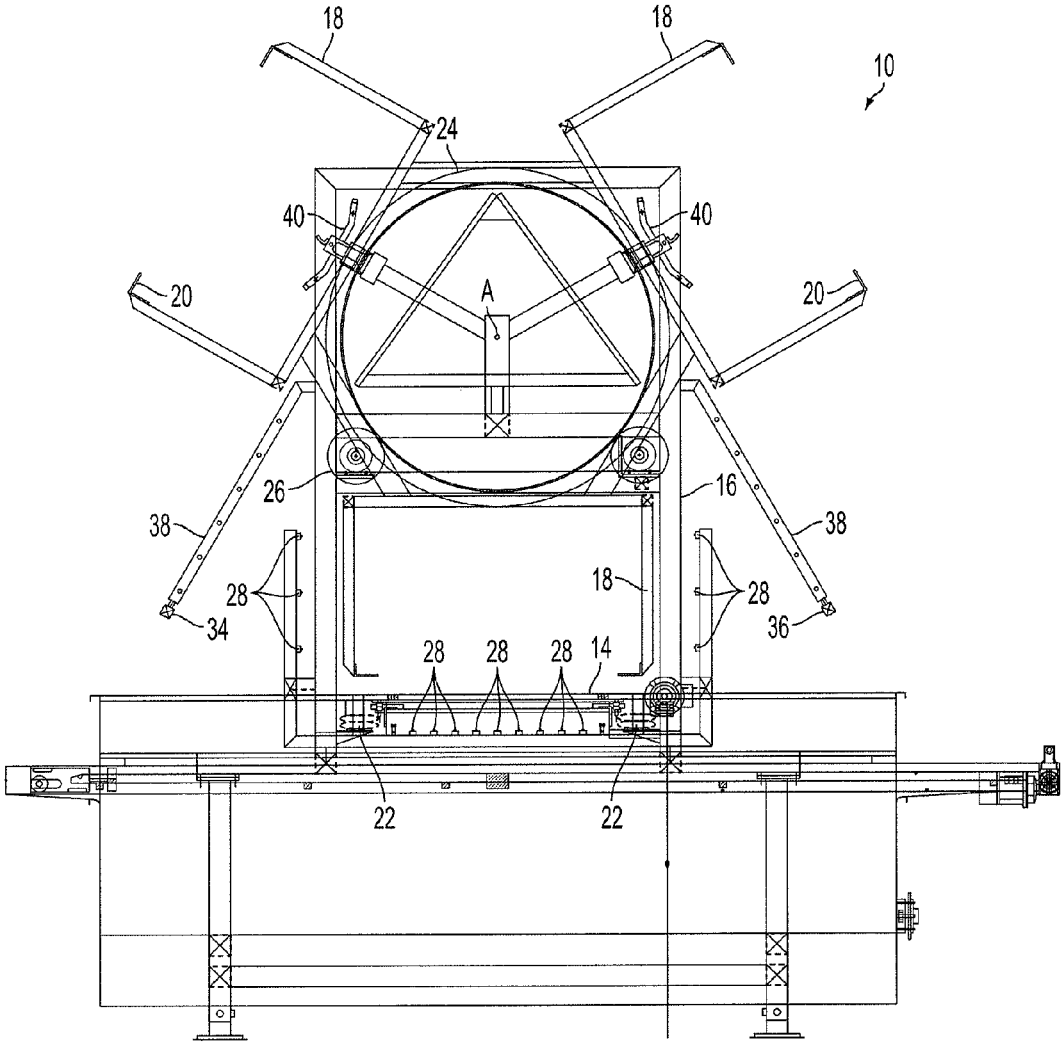
FIG. 2 is a front cross sectional view of a bin washer according to another exemplary embodiment of the present invention.
Figure 3:
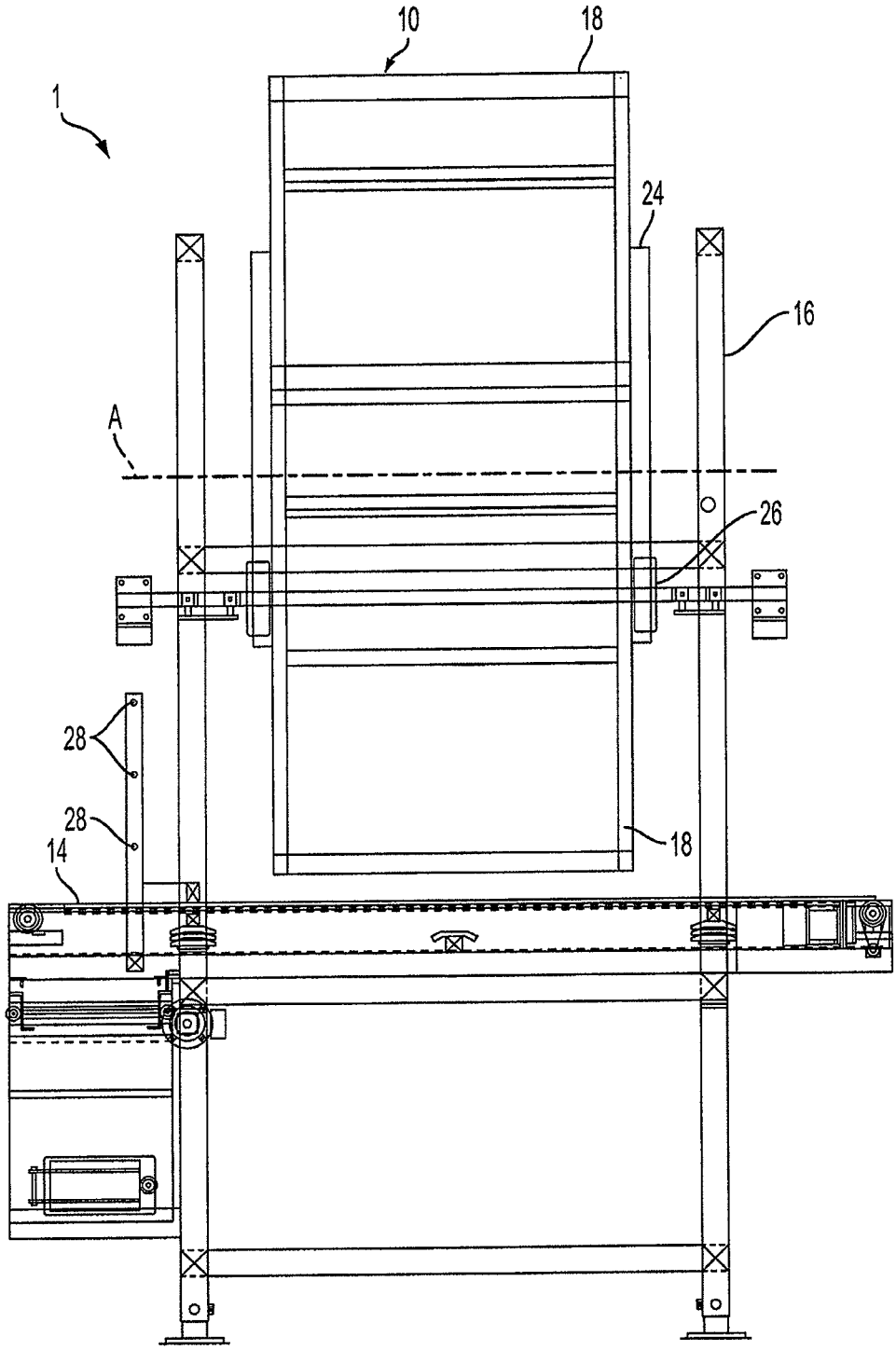
FIG. 3 is a side view of the bin washer of FIG. 2.

FIG. 1 illustrates a bin washer device 10 that is disposed at a washing station 1 along a conveyor 14 for moving bins 12 in a conveying direction. The device 10 has a structural support 16 disposed at a location along the conveyor 14.

A plurality of bin holders 18, at least two and preferably three or more bin holders 18, are rotatably supported on the support 16 and are all rotatable about a same longitudinal axis A that is disposed in a direction that is parallel to the conveying direction of the conveyor 14 and above the conveyor 14. The bin holders 18 are radially spaced from and circumferentially arranged about the axis A and are spaced from one another. In FIG. 1, the conveying direction of conveyor 14 is into the sheet. In the exemplary embodiments, each bin holder 18 comprises a member that is U-shaped in cross section and has two open sides spaced from one another along the conveying direction, the opening in the sides being sized to receive an entire bin and to hold the bin in the U-shaped member.

The support 16 is structured to point rotation of the plurality of bin holders 18 in sequence to and from an entry position that is located directly below the axis of rotation A, out of the entry position into washing positions, and finally back into the entry position. In the entry position, the bin holder 18 receives a respective bin 12 while the bin 12 is face up, and thereafter rotates the bin 12 to washing positions where the respective bin 12 is sprayed. Once the bin holder 18, holding a respective bin 12, is moved back to the entry position, the bin 12 is conveyed away through the open side of the bin holder 18 by operation of the conveyor 14. In the entry position, the U-shaped member is inverted with the opening facing down and its open sides positioned to receive a bin 12 as it is conveyed by the conveyor 14. However, as would be clear to one skilled in the art, the bin holder 18 and support 16 are not limited to this construction and may be any structure capable of holding a bin in a rigid manner while rotating the bin in a path away from and back to the conveyor while washing the bin 12 during rotation.

As shown in FIG. 1, the bin holders 18 are supported above the conveyor 14 at a predetermined distance wherein when one of the bin holders 18 is located directly below the axis of rotation A, a bin 12 held in that bin holder 18 (i.e., in an entry position) is in contact with the conveyor 14.

In this manner, as the conveyor 14 conveys the bins 12, the bins 12 freely move into and out of the open sides of the inverted U-shaped bin holder 18. The bin holders 18 can effectively receive the bins 12 as they travel on the conveyor 14 and into the entry position, without altering the circular path of the bin holders 18 or the path of the bins 12.

A fastening member 20 is disposed on each bin holder 18 which detachably attaches one of the bins 12 to the bin holder 18. In the exemplary embodiments, the fastening member is a pair of flanges 20 that extends inwardly from and is rigidly attached to ends of the bin holder 18. A flange 20, for example, may be an angle iron. The bins 12 slide into the U-shaped bin holder 18 through an open side of the bin holder, wherein a bottom of the bin 12 rests on the flanges 20 such that the bin 12 moves with the bin holder 18 as the bin holder 18 rotates out of the entry position and into the washing positions, which may include washing, sanitizing, drying or similar processes.

A lifting mechanism 22 may be provided at an underside of the conveyor 14 to lift the bin 12 while in the entry position to assist the bin 12 when entering the bin holder 18. The lifting mechanism 22 may be one of many known arrangements for lifting a structure, such as electrical, hydraulic, or mechanical. The lifting mechanism 22 is actuated at a timing based upon the conveyance of the conveyor 12 and the rotation of the bin holders 18, such that a bin 12 is lifted as it is conveyed into the open side of the U-shaped bin holder 18 so that the bin 12 engages the fastening member 20. In the exemplary embodiments, the bin 12 is lifted so that the bottom surface of the bin 12 is conveyed above the fastening member 20.

An actuator which may be included (not shown) rotates the bin holders 18 about the axis A. The bin holders 18 may be supported about the axis A on a cylindrical support 24, wherein the actuator rotates the cylindrical support 24 about the axis A. In the exemplary embodiment, the large cylindrical support 24 is a drum and a plurality of small cylindrical members 26 engages the drum, wherein the actuator rotates one or more of the small cylindrical members 26.

A plurality of sprays 28, 30, 32, 34, 40 are provided adjacent the bin holders 18 for spraying water onto inner or outer surfaces of the bins 12. The water may contain a sanitizer. In an exemplary embodiment, the water is screened to a minimum of 150 microns, to allow the water to be recycled all day long, while still being able to use the sanitizer effectively. A water holding tank (not shown) houses the water to be used in the device 10. A heat exchanger (not shown) may be provided, to heat the water to allow for a higher degree of efficacy for killing pathogens, and/or removing soil or fruit debris. Preferably, the plurality of sprays 28, 30, 32, 34, 36, 40 are each supplied with water through a single water supply unit, but a separate unit can alternatively be used.

The plurality of sprays 28, 30, 32, 34, 36, 40 includes entry sprays 28 that are disposed in an array below the conveyor 14, in arrays slightly above and adjacent each side of the conveyor 14, and in an array directly above the conveyor. The entry sprays 28 spray water on the bottom surface, outer side surfaces, and the inner surfaces of a bin 12 which is in the entry position.

The plurality of sprays 28, 30, 32, 34, 36, 40 includes a plurality of outer sprays 30, 32, 34, 36 provided outside the path of the bin holders 18. For example, upper outer sprays 30, 32 may be provided overhead or above the bin holders 18, and lower outer sprays 34, 36 may be provided below or under the bin holders 18. As shown in FIG. 1, two upper outer sprays (one left upper outer spray 30 and one right upper outer spray 32) are positioned at predetermined angles relative to a vertical axis extending upwardly from the conveyor 14 perpendicular to the axis of rotation A of the bin holders 18. Two lower outer sprays (one left lower outer spray 34 and one right lower outer spray 36) are positioned below the bin holders 18 at predetermined angles relative to the vertical axis. The position of a spray refers to the direction the spray nozzle is pointing, or the direction that water will be sprayed from the spray. Preferably, the angles of each spray are offset slightly from 45 degrees.

The two sprays 30, 34 that are on the left side of the conveyor 14 are positioned perpendicular to one another. Similarly, the two outer sprays on the right side 32, 36 are positioned perpendicular to one another. In this manner, when the bin holders 18 are in a predetermined location of the path, one of the outer sprays on the left side sprays alongside a first side of the bin 12 while the other of the outer sprays on the left side sprays alongside a second side of the bin 12 perpendicular to the first side of the bin 12.

In the exemplary embodiment, the left upper outer spray 30 is angled negative 50 degrees from the vertical direction, and the left lower outer spray 34 is angled positive 40 degrees from the vertical direction, wherein negative degrees denotes a counterclockwise rotation in FIG. 1 and positive degrees denotes a clockwise rotation in FIG. 1. The right upper outer spray 32 is angled positive 50 degrees from the vertical direction, and the right lower outer spray 36 is angled negative 40 degrees from the vertical direction.

The outer sprays 30, 34 that are on the left side of the conveyor 14 are positioned at angles that mirror the respective outer sprays 32, 36 on the right side of the conveyor 14. In other words, the orientation of the upper outer spray 30 on the left side of the conveyor 14 mirrors that of the upper outer spray 32 on the right side of the conveyor 14. Similarly, the orientation of the lower outer spray 34 on the left side of the conveyor 14 mirrors that of the lower outer spray 36 on the right side of the conveyor 14.

Because the sprays 32, 36 on the right side of the conveyor 14 mirror the sprays 30, 34 on the left side, as the device 10 rotates, the right side sprays 32, 36 spray water alongside two sides different from those that the left side sprays 30, 34 sprayed.

The upper and lower outer sprays 30, 32, 34, 36 have spray banks 38 extending at the angle of the spray nozzle toward the bin holder. The spray banks 38 are fixed relative to the support and guide water from the respective spray and spray the water in a direction perpendicular to the respective spray. The outer sprays provide an intense volume of liquid, for example, approximately 120 gallons of water per minute.

As shown in FIG. 1, the plurality of sprays 28, 30, 32, 34, 36, 40 includes inner sprays 40 positioned at a location inside the outer periphery of the path of the bin holders 18. The inner sprays 40 are disposed on each bin holder 18 and travel with the bin holder 18. Preferably, the inner sprays 40 are rotary sprays that rotate while traveling with the bin holder 18 and may provide, for example, approximately 200 gallons of water per minute.

The water supply unit (not shown) that supplies water to the plurality of sprays 28, 30, 32, 34, 36, 40 is in communication with the water tank and by way of example, may run a total pressure of 50-60 lbs. To provide this overall system pressure, firstly the ideal size for the inner sprays 40 and outer sprays 30, 32, 34, 36 is determined that effectively cleans the bins 12. Thereafter, the number of entry sprays 28 can be increased or decreased in order to obtain a total pressure of 50-60 lbs.

First solenoid switches (not shown) control the rotating of the bin holders 18. Second solenoid switches (not shown) control the lifting mechanism 22. The solenoids are timed such that a bin 12 is lifted and conveyed into a bin holder 18 in the entry position while the bin holder 18 is paused in the entry position.

In operation, a bin 12 moving along the conveyor 14 reaches the washing station 1 that includes the bin washer device 10, and enters one of the bin holder 18 when the bin holder 18 is located directly below the axis of rotation A. In this entry position, the bin 12 is spray by the entry sprays 28. Thereafter, the bin 12 is held by the bin holder 18 and rotates with the bin holder 18. As the bin 12 rotates with the bin holder 18, the bin 12 is sprayed by an inner spray 40, and a plurality of outer sprays 30, 32, 34, 36. If the bin holder 18 is rotating in a clockwise direction in FIG. 1, the bin 12 would be sprayed first by the left outer sprays 30, 34, wherein the left lower outer spray 34 would spray alongside the bottom of the bin 12 and the left upper outer spray 30 would spray alongside the forward-most side of the bin 12. Lastly, the bin 12 would be sprayed by the right outer sprays 32, 36, wherein the right upper outer spray 32 would spray alongside the trailing side of the bin 12, and the right lower outer spray 36 would spray alongside the bottom of the bin 12.

Figure 4:
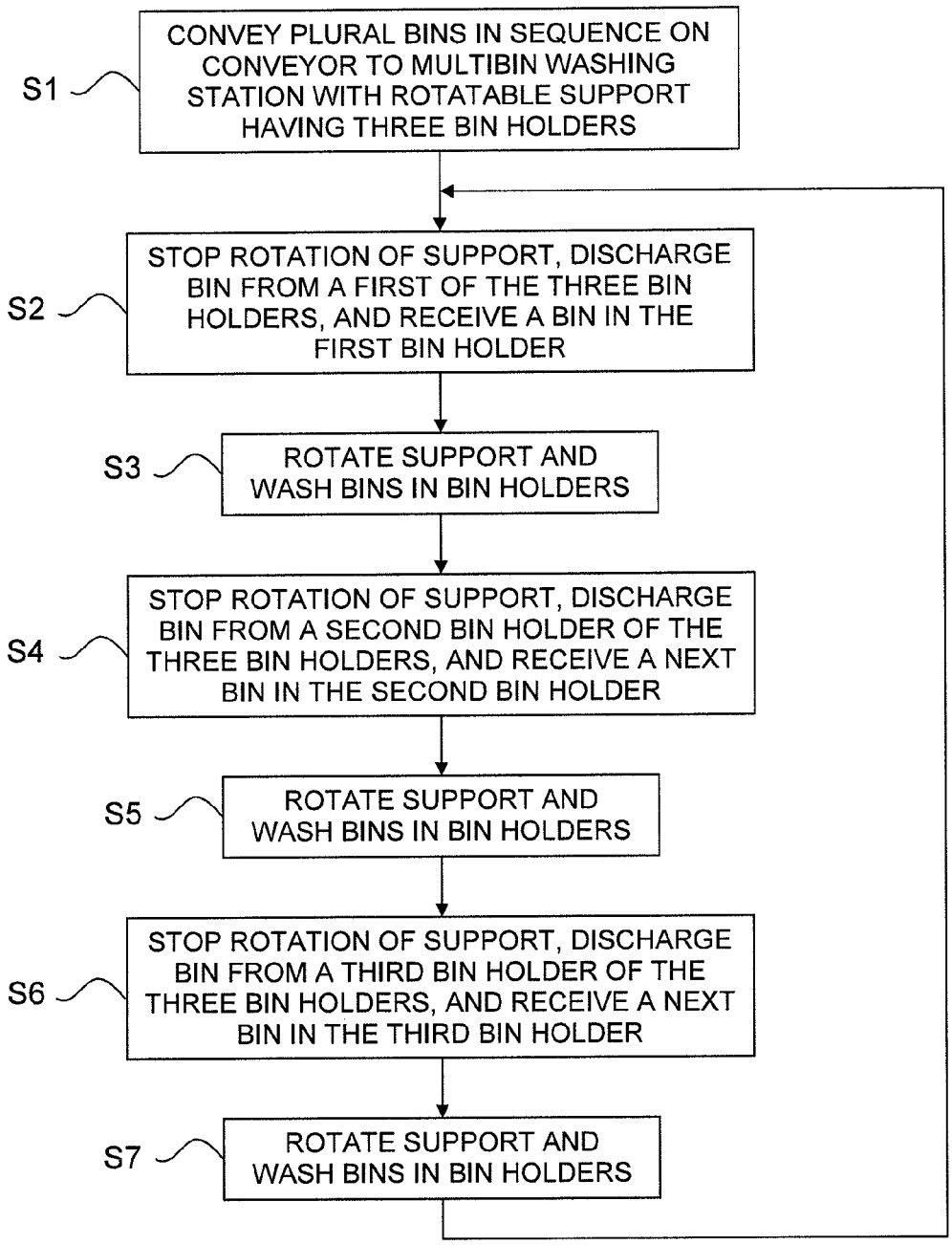
FIG. 4 is a flow chart illustrating a method of washing bins according to an exemplary embodiment of the present invention.

A method of washing a plurality of bins 12 that extends the wash time of each bin 12 is illustrated in FIG. 4. The exemplary embodiment of FIG. 4 illustrates a method using three bin holders, however, the method is not limited to a particular number of bin holders, provided there are at least two bin holders.

The exemplary embodiment of the method includes conveying the plural bins in sequence on a conveyor to a multibin washing station with a rotatable support having three bin holders in step S1. Next, the rotation of the support is stopped at step S2. While the support is stopped, one of the plural bins is discharged from a first one of the bin holders and another bin is received in the first bin holder at step S2. At step S3, simultaneously, the support is rotated and the bins in the bin holders are washed. At step S4, the rotation of the support is stopped, another one of the plural bins is discharged from a second one of the bin holders, and a next bin is received in the second bin holder. At step S5, simultaneously, the support is rotated and the bins in the bin holders are washed. At step S6, the rotation of the support is stopped, a bin is discharged from a third one of the bin holders, and a next bin is received in the third bin holder. After step S6, simultaneously, the support is rotated and the bins in the bin holders are washed at step S7. The stopping the rotation and the rotating of the support at steps S2-S7 are repeated to sequentially washed the bins that are conveyed on the conveyor.

If the N bin holders is a number other than three, the support is stopped, one of the bins is discharged from an x one of the N bin holders, a next one of the bins is received in the x bin holder, the support is then rotated and the bins in the bin holders are washed, for each integer value of x from 1 to N. That is, the steps are reiterated for each respective bin holder. Furthermore, the cycle from x equal to 1 to N is repeated to continuously wash the bins being conveyed using a single washing station.

The bin washer design is unique in that a plurality of bins 12 rotate in an orbit above the entry conveyor 14 in a single bin washer device. This design allows a bin 12 to be staged in the washer longer than specified dump speeds of the packinghouse particularly because multiple bins 12 can be washed simultaneously by the same bin washer device 10. In the exemplary embodiment, if fruit is dumped at a speed of 30 seconds per bin 12, because three bins 12 are staged in the single bin washer device at one time, the washing time for each bin 12 is extended to almost 90 seconds, creating a longer dwell time to cleanse and sanitize the bin surfaces. Furthermore, due to the angles of the sprays, all sides of a bin 12 are thoroughly sprayed therealong.

Although the invention has been explained in relation to certain exemplary and preferred embodiments, it is to be understood that many other possible modifications and variations can be made without departing from the spirit and scope of the invention as hereinafter claimed.

What is claimed is:

1. A bin washer device for washing bins comprising:

a conveyor for moving the bins in a conveying direction;

a support frame disposed adjacent the conveyor and having a central axis of rotation;

at least two bin holders attached to the support frame and rotatable about the central axis of rotation of the support frame, wherein at least one of the bin holders is configured to remove a bin from the conveyor and invert the bin by moving the bin relative to the conveyor, a plurality of outer sprays disposed outside a path of the bin holders and each positioned at a predetermined angle relative to a vertical direction perpendicular to the central axis of the support frame, wherein the central axis of the support frame extends parallel to the conveying direction of the conveyor, wherein the plurality of outer sprays includes a plurality of upper outer sprays disposed at a first position and a plurality of lower outer sprays disposed at a second position below the first position, wherein each of the upper outer sprays corresponds to one of the lower outer sprays and the angle of the upper outer sprays is offset by 90 degrees from the angle of the corresponding lower outer spray, and wherein:

the plurality of upper outer sprays includes a left upper outer spray and a right upper outer spray, the plurality of lower outer sprays includes a left lower outer spray and a right lower outer spray, the angle of the left upper outer spray is a mirror-image of the angle of the right upper outer spray, the angle of the left lower outer spray is a mirror-image of the angle of the right lower outer spray, whereby as the bin holder rotates a bin the sprays spray alongside plural surfaces of the bin.

2. The bin washer device according to claim 1, wherein the central axis of the support frame is disposed above the conveyor.

3. The bin washer device according to claim 1, wherein the bin holders are radially spaced from the central axis of the support frame, and circumferentially spaced from one another.

4. The bin washer device according to claim 1, further comprising a fastening member disposed on each bin holder which detachably attaches one of the bins to the bin holder.

5. The bin washer device according to claim 1, further comprising three bin holders rotatably supported on the support frame.

6. The bin washer device according to claim 1, further comprising an inner spray disposed on each bin holder.

7. The bin washer device according to claim 1, further comprising an actuator which rotates the bin holders.

8. The bin washer device according to claim 7, further I comprising a shaft that is rotatable relative to the support frame, wherein the actuator engages the shaft.

9. The bin washer device according to claim 7, further I comprising a first gear supporting the bin holders around the central axis of the support frame, and a second gear engaging the first gear, wherein the actuator rotates the second gear.

10. A method of washing plural bins as according to the apparatus of claim 1, comprising:

conveying the plural bins in sequence on a conveyor to a multibin washing station with a rotatable support having N bin holders, wherein N is an integer equal to 2 or more;

stopping a rotation of the support;

discharging one of the plural bins from an x one of the bin holders, wherein x is an integer from 1 to N;

receiving a next one of the plural bins in the x one of the bin holders;

rotating the support and washing the bins in the bin holders;

reiterating the stopping the rotation, the discharging the one of the plural bins, the receiving of the next one of the plural bins, and the rotating of the support and washing of the bins in the bin holders sequentially for each value of x from 1 to N.

11. The method of claim 10, wherein N is equal to 3 or more.

12. The method of claim 10, further comprising repeating the reiterating step.

* * * * *